United States Patent [19]

Schindele et al.

[11] 3,996,769

[45] Dec. 14, 1976

[54] NEEDLE CONTROLLING MECHANISM FOR CIRCULAR KNITTING MACHINES

[75] Inventors: Alfred Schindele, Harthausen; Gerhard Mueller, Berkheim, both of Germany

[73] Assignee: C. Terrot Soehne, Stuttgart, Germany

[22] Filed: Dec. 19, 1974

[21] Appl. No.: 534,372

[30] Foreign Application Priority Data

Oct. 4, 1974 Germany ..... 2447427

[52] U.S. Cl. ..... 66/50 R; 66/38; 66/57; 66/199

[51] Int. Cl.[2] ..... D04B 9/00

[58] Field of Search ..... 66/50 R, 25, 38, 57, 66/30, 19, 172 R, 39, 20, 199

[56] References Cited

UNITED STATES PATENTS

| | | | |
|---|---|---|---|
| 3,620,047 | 11/1971 | Paepke | 66/25 |
| 3,742,733 | 7/1973 | Paepke | 66/50 R |
| 3,744,275 | 7/1973 | Harris | 66/50 R |
| 3,771,327 | 11/1973 | Engelfried | 66/50 R |
| 3,823,579 | 7/1974 | Schindele et al. | 66/50 R |
| 3,835,668 | 9/1974 | Schiebel et al. | 66/50 R |

FOREIGN PATENTS OR APPLICATIONS

| | | | |
|---|---|---|---|
| 1,546,919 | 10/1968 | France | 66/50 R |
| 1,373,258 | 8/1964 | France | 66/50 R |
| 1,230,961 | 12/1966 | Germany | 66/25 |
| 2,304,651 | 8/1973 | Germany | 66/57 |

*Primary Examiner*—Mervin Stein
*Assistant Examiner*—A. M. Falik

[57] ABSTRACT

An improvement in multi-feed circular knitting machines wherein the knitting needles are adapted to assume knitting and non-knitting conditions and whereas the jacks are suspended in the knitting needles in an articulated manner. The cam clyinder is provided with a needle lowering cam at each cam system. Each jack has at least one butt adapted to be engaged by the needle lowering cam when the corresponding jack has been swivelled on to the cam cylinder. The improvement comprises the construction and the manner of interaction of the butts and the needle lowering cam. The butts are arranged on the swivellable jacks and are selectively adapted to be pivoted away from the cam cylinder by means of a special pivoting device in each system when the corresponding needle is to misknit, that is in advance of the needle lowering cam of the system and are adapted to be swivelled back to their original position by special means immediately after having passed the needle lowering cam.

2 Claims, 8 Drawing Figures

NEEDLE CONTROLLING MECHANISM FOR CIRCULAR KNITTING MACHINES

BACKGROUND OF THE INVENTION

The invention relates to a multi-feed circular knitting machine with needles, which can be controlled so as to assume a knitting and a non-knitting condition, and also selector jacks which are suspended in articulated manner in the needles, which jacks are pivotable as a body on to the cams by means of pivoting devices which act directly on the jacks, these jacks also being susceptible of being pivoted away from the cams, each needle having associated with it a butt which cooperates with a needle lowering cam in a cam track of each cam.

In the case of high speed circular knitting machines, with a relatively large number of feeds per machine, the highest permissible machine speed is substantially restricted by the fact that the non-knitting needles, which run through the particular feed mechanism of the machine on a so-called circular (guide) control path, run, with their butts which serve to lower the needles concerned, against the needle lowering control cam, when these needles are in their non-knitting position opposite the particular feed of the machine. As the cam track has a comparatively steep inclination in the vicinity of the needle lowering cam, these butts impact with considerable force on the needle lowering cam, as a result of which longitudinal vibration is set up in the needles. After the machine has been running for some time, this vibration can lead to needle breakage. Considerable wear of the needles and also of the cam parts is also caused.

In German published patent application No. 1,785,337 a multi-feed Jacquard circular knitting machine of the type described herein is also disclosed in whose needles, and needle jacks are suspended in articulated manner. In this known machine it is possible to prevent butts of non-knitting needles — these butts being arranged on the needles and cooperating with the needle lowering cams — from striking against the particular needle lowering cam concerned. To this end each needle jack has a butt for which a control surface of gentle inclination is arranged in each cam, this control surface serving to draw downwardly the needle jacks — together with the non-knitting needles, associated with these jacks and also the needle lowering butts of these non-knitting needles — before the needle lowering part is reached. This downwardly directed movement continues until the needle butts, which are being guided round the so-called circular guide (control) path, no longer strike against the needle lowering cam. In order to prevent this gently inclined control surface from acting on those needle jack butts which are associated with needles which are knitting, the cam part which defines the gently inclined control surface also defines a slide suface at the level of the track or path followed by the needle jack butts associated with the needles which are knitting, so that the needle jacks to which these butts are attached are pivoted away from the cam in front of the gently inclined control surface. Accordingly, this known Jacquard circular knitting machine requires the following elements: first pivoting devices, which are capable of pivoting needles (in principle it could be the needle jacks which are thus acted on) away from the cam at the selection station of each feed of the knitting machine, and which are also capable of pivoting these needles back onto the cam shortly after the selection station has been passed, thus ensuring that certain needles (as determined by the selection pattern) will not knit; cam parts, which define the above-mentioned gently defined control surface, and which guide the needle jack butts of non-knitting needles gently round the needle lowering cam of the feed concerned; also a second pivoting device in the form of a slide — or contact — surface, which serves to prevent the above-mentioned gently inclined control surface from acting on the needle jack butts of the needles which are knitting.

Underlying the present invention is the object of providing a circular knitting machine of the kind defined at the outset, in which it is possible with relatively simple structural means, to prevent the butts of non-knitting needles (these butts serving to lower the needles) from impacting against the needle lowering cams.

SUMMARY OF THE INVENTION

To this end, it is proposed, according to the invention, to arrange the butt, which cooperates with the needle lowering cam, on the pivotable selection jack and, by means of the pivoting devices, to pivot the selection jacks of the non-knitting needles away from each cam — this taking place in advance of the needle lowering cam portion of the cam concerned — and to pivot these selection jacks back on to the cam directly after having passed the needle lowering cam. In this way it is possible to dispense with the gently inclined control surfaces, forming part of the above-mentioned known circular knitting machine, and also with the additional butts, which cooperate with these gently inclined control surface, as the part which bears the needle lowering butt is itself outwardly swivelled.

The basic concept of the invention is applicable with particular advantage to Jacquard frames, if the needle lowering butt is arranged on the outwardly pivotable needle jack, because the outward swivelled movement of the needle jacks — this outward movement being in any case necessary, and being controlled on the basis of the selection pattern — ensures that the needle lowering butts can no longer impact against the needle lowering cams.

The concept underlying the invention is also suitable for application to so-called plain machines. Circular knitting machines of this kind have a plurality of types of needles, and also have, in each cam system a number of needle clearing cams which correspond to the number of the types of needles, these needle clearing cams being situated one above the other. These circular knitting machines also have a needle lowering cam which is common to all the types of needles employed. Consequently, each needle has a first butt, responsible for clearing the needles, and a second butt, responsible for lowering the needles; the clearing butts are arranged at different heightwise levels in the case of the different types of needle. Switches, thruster members or the like determine which type of needle is to knit or is to misknit at a given time. The circular knitting machines of known costruction also entail the drawback that the needle lowering butts of the non-knitting needles, which are passing round a so-called circular guide (control) path of the track, impact against the needle lowering cam. In accordance with the teachings of the present invention, this can be prevented by arranging the butts which cooperate with the needle lowering cam on the pivotable selection jack, as the needle lowering butts of non-knitting needles can then pivot away from the cam in front of the said needle lowering cam. If the needle clearing butts are arranged on pivotable needle jacks, the needle lowering butts may be directly arranged on the needle butts.

It is already known (see, for example, German published application Ser. No. 2,021,742) in the case of flat knitting machines, to thrust the butts of non-knitting needles — these butts serving to effect needle clearance and to lower the needles, and being arranged on needle jacks — out of the cam track and in this way to guide these butts round the said needle lowering cam, these butts only being urged back into the cam track after having passed the said needle lowering cam. With this in view, and in the case of the known flat knitting machine, the needle jacks are constructed so as to be capable of a resilient bending movement, and they carry the butt in their central portion. A pattern jack is positioned against each needle jack, and this pattern jack can be so pressed, by means of pattern devices, against the needle jack so that the butt of the latter leaves the cam track. This cam track comprises needle clearing or draw-off cams and needle lowering cams, and four pattern devices are provided owing to the reciprocating movement of the carriage of the known flat knitting machine, which accommodates the cam track, relative to the needle bed of this flat knitting machine, the first and fourth of these pattern devices respectively lying at the start or end of the needle clearing (draw-off) cam and of the needle lowering cam respectively, while the second and third pattern devices are associated with the tuck position, that is to say they lie approximately at the center of the needle clearing or draw-off cam. In this area the needle clearing or draw-off cams have non-inclined portions. If it is intended that a needle shall now misknit, the butt of the associated needle jack is thrust out of the cam track, at the starting portion of the needle clearing cam, but the first pattern device and is prevented, in advance of the said needle lowering cam and by the fourth patterning device, from reentering the cam track, so that the needle jack butt cannot impact on the said needle lowering cam. If a needle is controlled so as to assume its tuck position, the second pattern device becomes effective, so that the associated needle jack butt is thrust out of the cam track approximately in the center of the needle clearing cam. By reason of the resilience of the needle jack, the needle jack butt then snaps back into the cam track at the level of the third pattern device and approximately at the center of the draw-off cam. If a tuck loop which has been placed into the needle, is not to be drawn out, but is to remain in position in the needle, the fourth pattern device becomes active. This fourth pattern device thrusts the needle jack butt out of the cam track again at a point in front of the said needle lowering cam. On the other hand, if the fourth pattern device assumes its inoperative position, the tuck loop can be completely drawn out by the needle lowering cam. It is thus the purpose, in the known knitting machine, of the four pattern devices to enable all possible knitting procedures of the needle to be controlled, and naturally, the fourth pattern device is also necessary, in advance of the needle lowering cam, for the reverse direction of movement of the carriage, for the purpose of preventing the needles from knitting there. Thus, the known flat knitting machine could in no way suggest a solution of the object underlying the present invention, as the fourth pattern device does not serve the purpose of preventing needle breakage due to the needle jack butts of non-knitting needles forcefully impacting on the needle lowering cam (the relative speeds between needles and carriage are much too low for this to happen in the case of flat knitting machines). Furthermore, the fourth pattern device would be necessary, in the case of the known knitting machine, by sole virtue of the fact that, in its vicinity, the cam track must accommodate the needle jack butts in practically clearance-free manner, so that the needle jack butts of non-knitting needles could never return, in the absence of the fourth pattern device, quickly enough into the cam track, but would be sheared off. Irrespective of this, the known form of construction entails a number of drawbacks. Thus, the resilience of the needle jacks must result in considerable wear of the needle jack butts and of the cam parts, as the needle jack butts of non-knitting needles are urged, subject to pressure, against the cam parts, and also the four pattern devices are of a relatively complicated structure. Finally, it is necessary to provide separate selector jacks in addition to needles, needle jacks and pattern devices, and the needle jacks must be of resilient construction because this represents the sole means of ensuring that the needle jack butts will be brought back into the cam track.

It will also be possible — in the case of circular knitting machines, in whose needles needle jacks are suspended in articulated manner, and in which controllable pivoting devices, which act on the needle jacks, determine, at a selection station of each feed of the knitting machine, whether a needle is to knit or misknit at a given time — to realize the object underlying the present invention by, in a known manner, pivoting the needle jacks of non-knitting needles on to the cam concerned, directly after the selection station, and to pivot these needle jacks in the reverse direction before the said needle lowering part has been reached. However, it is simpler if, for the purpose of enabling the needle lowering cams to be by-passed, the pivoting device, serving to pivot away the needle jacks, is arranged at the selection station, so that the needle jacks of non-knitting needles in each feed of the circular knitting machine frame only have to be swivelled once away from the cam and back thereto.

Under certain circumstances the action whereby the needle lowering butts are swivelled away from the needle jacks may cause the non-knitting needles to be displaced in their longitudinal direction, that is to say to be forcibly thrown. In the case of a preferred embodiment of the invention this can be avoided by constructing the selection jack, one of which is associated with each needle and which carries the needle lowering butt, as a two-arm lever, whose arm, located closer to the needle, carries a second butt which is directed towards the cam, the cams having, for this second butt, a circular control track for guiding the non-knitting needles transversely of the longitudinal direction of the latter. In this way not only are the knitting needles, but also the simultaneously non-knitting needles always guided in the circumferential direction of the needle cylinder, as the second butt of the selection jacks, which are suspended in articulated manner from the needles, always enter an appropriate guide track of the cams when the needle lowering butt is swivelled away from the cams.

By means of this form of construction it is also possible to eliminate a further drawback in the case of circular knitting machines of the type defined at the outset.

Thus, when certain types of fabric structure are to be knitted — that is to say when stitches of markedly different length are produced in successive feeds of the knitting machine — it is frequently difficult to ensure that short loops will be reliably cast off from the needle heads, this being particularly true if the circular knitting machine concerned has a large number of feeds, so that under certain circumstances lack of space will prevent a subsequent needle lowering action. If a delay-action cam is provided in the circular control track for the second butts, this delay-action cam will enable the short loops to be reliably cast off from the needle heads, because needles in those feeds which follow the knitting of a short loop are always guided by the circular control track, that is to say they are not knitting at the time concerned.

DESCRIPTION OF THE DRAWINGS

Further features and characteristics of the invention will be apparent from the following description of three embodiments of the invention, illustrated in the appended diagrammatic drawings, which illustrate two Jacquard circular knitting machines and a so-called "plain" knitting machine. In these drawings.

DESCRIPTION OF PREFERRED EMBODIMENTS

Figure 1A:
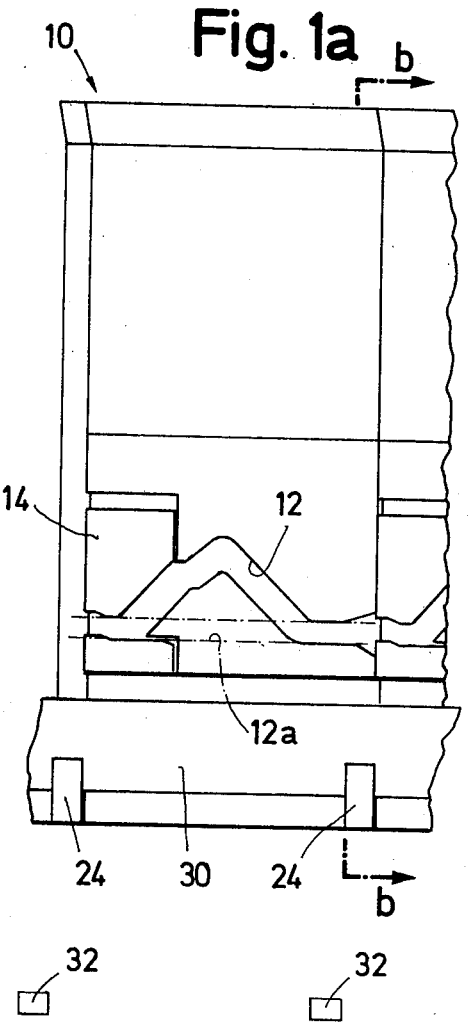
FIG. 1*a* is an elevation of a cam of a Jacquard circular knitting machine, as seen from the needle cylinder.

FIG. 1*a* shows a complete cam system of a Jacquard circular knitting machine, and also partially shows another cam system which is positioned in front of the first-mentioned cam system, as considered in the direction of travel. The completely represented, stationary cam cylinder is generally designated as 10. This completely represented cam system has a cam track 12, which is partially defined by a stitch cam part 14, constructed as a slider member. In a conventional manner buttless needles 16*a* are slidably guided in a needle cyliner (not shown), which is surrounded by the cam cylinder 10, needle jacks 16*b* being suspended in articulated manner from the buttless needles 16*a*. Each of these needle jacks 16*b* has a single butt 16*c*. The lower end of the needle jack 16*b* is surrounded and engaged by the fork 22*a* of a forked selector jack 18, which is swivelably retained in a mounting 19, which is either solely formed by the needle cylinder or by the needle cylinder together with the cam box ring (not shown). The selector jack 18 has, below its fork, a butt 20, and an arm 22 is fast with the side of the fork 22*a* lying closer to the cam cylinder 10, this arm 22 engaging over a return cam 24 onwardly from a selection system which will be described below, one of these selection stations being provided for each cam system. This return cam 24 is stationarily arranged on the cam box ring 30, which carries the cam cylinder 10. Selectors 32 are guided for radial sliding movement in the cam box ring 30 (not shown in its entirety), at the level of the butts 20 of the selector jacks 18. These selectors 32 form a so-called selection station. When individual selectors 32 are moved into their outwardly thrust positions, the needles 16*a* associated with these particular selectors knit, whereas when selectors 32 are thrust inwardly and radially into the cam box ring 30, the needles 16*a* associated with these particular selectors misknit at the particular feed concerned of the knitting machine.

Figure 1B:
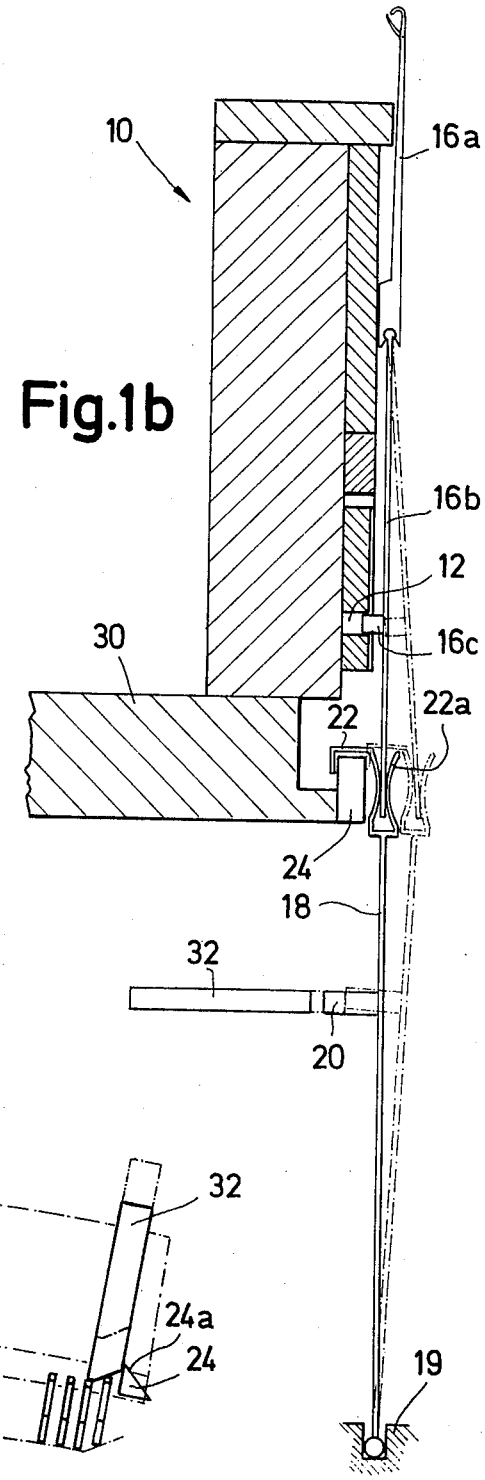
FIG. 1*b* is a sectional view taken on the line*b—b* in FIG. 1*a*, the needle cylinder having been omitted, for the sake of simplicity, apart from one of the bearings.

Naturally, FIGS. 1*a* and 1*b* represent the machine in a simplified fashion, as (according to conventional practice), the forked selector jacks 18 ar subdivided into groups and the successive selector jacks 18 of a group have their butts positioned at different levels. Accordingly, each cam system has a number of selectors 32 which corresponds to the number of forked selector jacks of the system, these selectors 32 being positioned at different levels (i.e. heights).

Figure 1C:
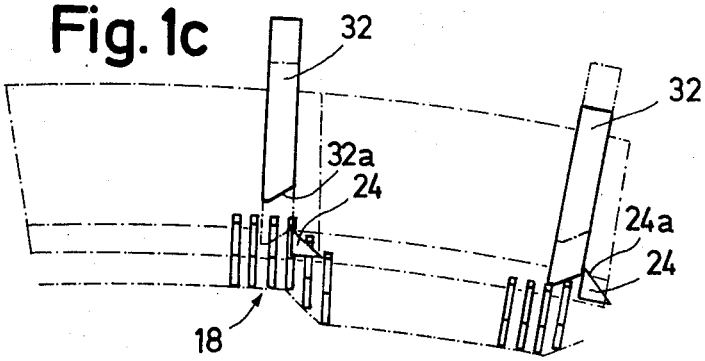
FIG. 1*c* is a plan view of the pivoting devices of two knitting feeds, in which some of the forked jacks, associated with the needles, are illustrated together with two cams.

This Jacquard circular knitting machine operates in the following manner:

When the selector 32, associated with a specific knitting feed or cam system (and with a specific type of selector jack), is retracted, as is illustrated in the left-hand portion of FIG. 1*c* the butts 16*c* of the needle jacks remain in the cam track 12, after these butts 16*c* have been pivoted towards the cam cyliner 10 in advance of the selection station, represented by the selector 32. This pivoting motion of the butts 16*c* takes place as a result of the forked selector jacks 18 being pivoted, by an oblique surface 24*a* of the return cam 24 (located upstream of the selection station), in the direction toward cam cylinder 10. This position assumed by the forked selector jack 18 is shown in FIG. 1*b* in continuous line. The associated needles then knit normally in this feed system of the knitting machine.

However, if (as illustrated in the right-hand portion of FIG. 1*c*), selector 32 is thrust inwards, the forked selector jacks 18 are again swivelled away from the cam cylinder 10 at the selection stations; this is effected by the oblique control surface 32*a* of the selector 32 and is illustrated in dashed line in FIG. 1*b* and in left-hand portion of FIG. 1*c*. The selector jacks 18 thus entrain the needle jacks 16*b*, and cause the butts 16*c* of the needle jacks 16*b* to move out of engagement with the cam track 12. The butts 16*c* of the needle jacks do not swivel back towards the cam cylinder 10 immediately after they have left the selection station (selector 32), but remain in the outwardly pivoted position illustrated in dashed line in FIG. 1*b*. In this position the butts 16*c* run past the cams of the cam cylinder 10 in the so-called circular control (guide) track 12*a*, which is illustrated in dashed line in FIG. 1*a*. The butts 16*c* continue to be guided in the circular guide track 12*a* until, in the next feed system of the knitting machine, they are pivoted back towards the cam cylinder 10, by the return cam 24 associated with this next feed system and subject to the control of the forked selector jacks 18. In this way the butts 16*c* of the needle jacks of the non-knitting needles pass the stitch cam part 14, and do not come into contact with the latter, as is clearly apparent from FIG. 1*b*.

Figure 2A:
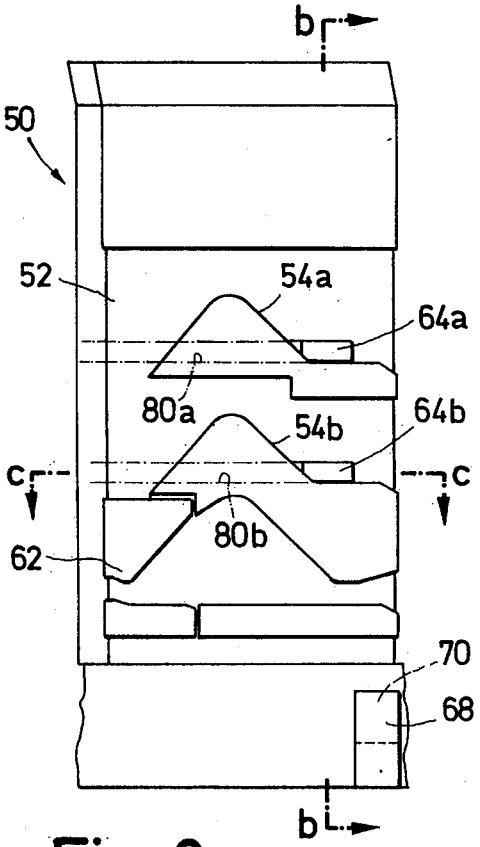
FIG. 2*a* is an elevation of a cam of a so-called "plain" knitting machine, as seen from the needle cylinder.
Figure 2B:
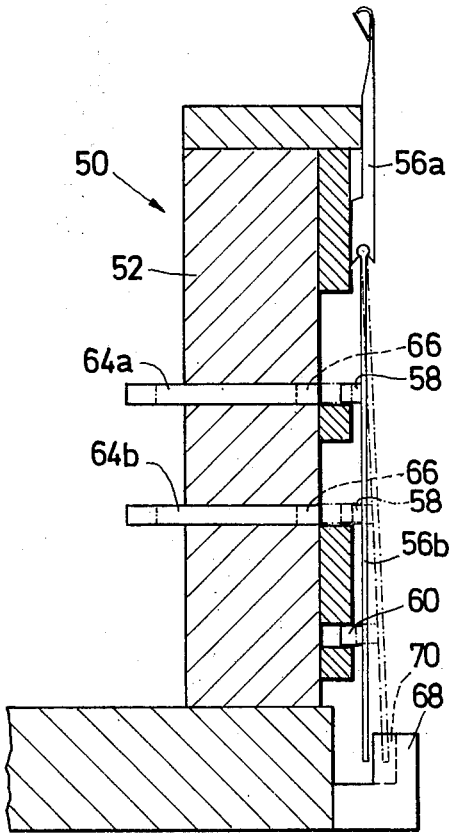
FIG. 2*b* is a cross-sectional view taken along the line *b—b* of FIG. 2*a;*
Figure 2C:
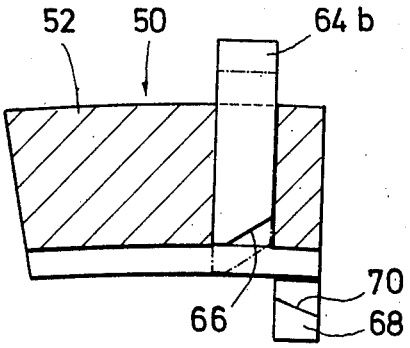
FIG. 2*c* is a cross-sectional view taken along the line *c—c* of FIG. 2*a;*

FIGS. 2*a* – 2*c* illustrates a second embodiment wherein a cam cylinder designated as a whole by reference symbol 50, of a so-called "plain" circular knitting machine, the parts of this cam cylinder being assembled in a conventional manner in a cam box ring 52. The illustrated knitting machine is of the two cam track type, which has two clearing cams 54*a* and 54*b*, which lie one above the other in each cam system. Consequently, two types of needle jacks 56*b* provided in the needle cylinder (not shown), these needle jacks 56*b* being suspended in articulated manner in the needles 56*a*. The two types of needle jacks are distinguished from one another by the position of their clearing butts 58. Thus, in the case of one type of needle jack, the clearing butt lies at the level or height of the clearing cam track portion 54*a*, whereas, in the case of the other type of needle jack, the clearing butt lies at the level of the clearing cam track portion 54*b*. However, all the needle jacks have a stitch butt 60 at the same level, i.e. height. Consequently, each cam has only one stitch cam track part 62. A respective selector 64*a*, 64*b* is thus provided for each clearing cam track part and, accordingly, for each type of needle jack, these selectors 64*a* and 64*b* being guided for radial sliding movement in the cam box ring 52 and defining in their front portion an oblique surface 66 for controlling the position of the needle clearing butts 58. Moreover, each cam system and each feed system of the knitting machine is assigned a return cam 68, which is stationarily arranged at the start of the feed system and on the cam box ring 52, this return cam 68 having an oblique surface 70, which cooperates with the lower ends of the needle jacks 56*b*.

The "plain" knitting machine according to the invention operates in the following manner:

When the needles of a specific type are intended to knit, the selectors 64 associated with these particular needles are retracted into the position indicated in FIG. 2*c* by continuous lines. As, at the start of each feed of the knitting machine, all the selectors 56*b* are pivoted towards the cam 50 by the return cam 68, the needle clearing butts 68 of those needle jacks whose associated selectors 64 have been retracted engage in their assigned needle clearing cam track portion 54, so that the needles associated with these needle clearing butts 58 knit. In the course of the knitting process stitch butts 60 of the needle jacks are drawn round the stitch cam track part 62.

When needles of a particular type of needle jack are intended to misknit in a particular cam or feed system of the knitting machine, the selector 64, associated with this particular type of needle jack, is slid radially inwards towards the needle cylinder, as is indicated in dashed line in FIG. 2*c*. The butts 58 of the needle jacks 56*b* associated with the selectors 64 then come into contact with the oblique control surface 66 of the selector 64, and are pivoted inwardly and away from the cam cylinder 50, so that the needle clearing butts engage in, and are guided by, the circular control track 80*a*, 80*b*, shown in chain-dotted line in FIG. 2*a*, so that these butts 58 pass by the needle clearing camming surface 54. Owing to the needle jacks 56 being pivoted away from the cam cylinder in the direction of the needle cylinder, it is at the same time ensured that the needle lowering butts 60 of a particular type of needle jack concerned will also pass by the needle lowering camming surface 62, and will not come into contact with the latter. At the start of the next feed system of the knitting machine, all the needle jacks 56*b* are then pivoted back toward the cam cylinder 50 by the return cam 68.

Figure 3A:
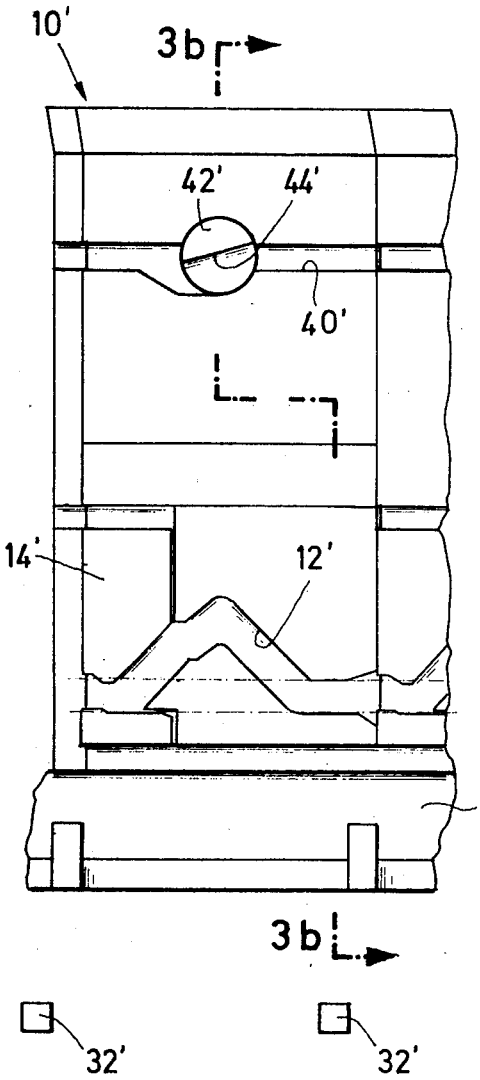
FIG. 3*a* is an elevational view of a cam of another Jacquard circular knitting machine, as viewed from the needle cylinder.

FIG. 3*a* is a third embodiment of the invention wherein one cam system of a Jacquard circular knitting machine is illustrated. FIG. 3*a* partially also shows a further cam system which lies in advance of the first-mentioned cam system, as considered in the direction of movement. The stationary cam cylinder, which is not illustrated in its entirety, is generally designated as 10'. This cam cylinder has a first cam track 12', which is partially defined by a needle lowering cam 14', formed as a slidable member. In a conventional manner needles 16' are guided for sliding movement, in their longitudinal direction, in a needle cylinder, which is not shown and is surrounded by the cam cylinder 10'. According to the invention these needles have a buttfree upper portion 16*a'*, which forms the needle head, and a lower part 16*b'*, which is suspended in articulated manner in the upper part 16*a'* of the needle and forms a kind of needle jack, this lower part 16*b'* of the needle having, below the articulated joint 17', a butt 16*c'* and, above the articulated joint, a second butt 16*d'*. The lower end of the lower part 16*b'* of the needle is surrounded by a fork of a selector jack 18', which is pivotably secured in a mounting or bearing 19'. This mounting 19' is either solely formed by the needle cylinder or by the needle cylinder together with a cam box ring (not shown). Below its fork the selector jack 18 has a butt 20', and an arm 22' is fast with the side of the fork lying closer to the cam, this arm 22' engaging round a return cam 24' onwards from a selection station, which will be described below and a respective one of which is provided at each cam system. The return cam 24' is stationarily arranged on the cam box ring 30' which carries the cam cylinder 10'. Also, selectors 32' are guided for radial sliding movement in the cam box ring (not shown in its entirety), the selector 32' lying at the level, i.e. height, of the butts 20' of the selector jacks 18'. In each cam system these selectors 32' represents the so-called selection station. When individual selectors 32' are in their outwardly thrust position, the needles 16' associated with these particular selectors will knit, whereas the needles 16' associated with the selectors 32' which are radially retracted into the cam box ring will run through the feed system concerned of the knitting machine along a circular control track provided for this purpose.

Figure 3B:
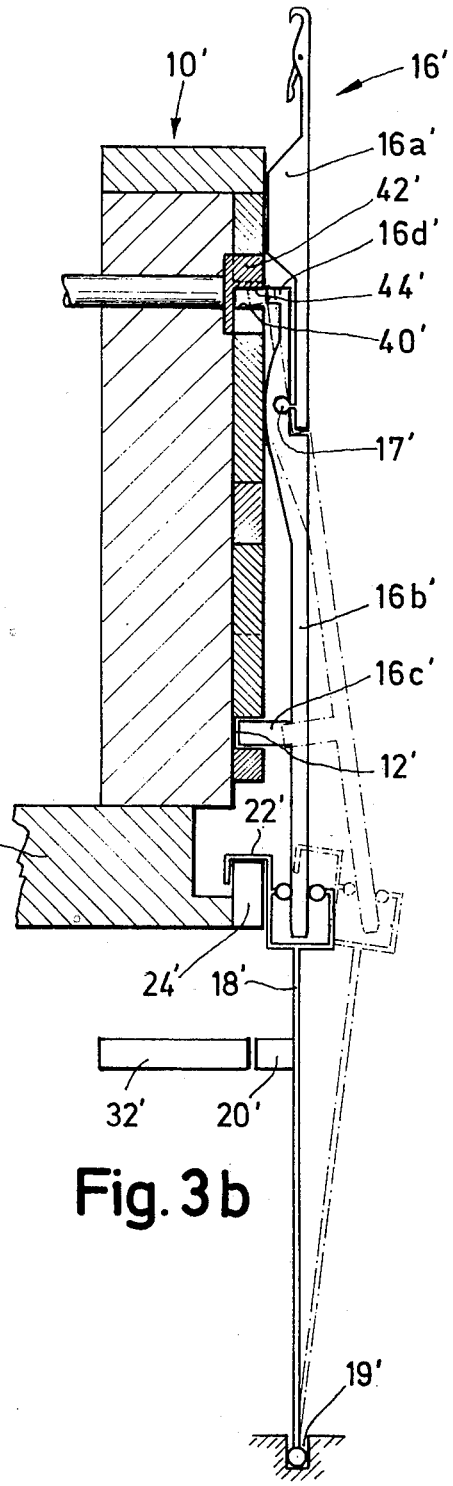
FIG. 3*b* is a cross-sectional view taken along the line 3*b* — 3*b*of FIG. 3*a*, the needle cylinder being omitted, for the sake of simplicity, apart from one of the bearings.

Naturally, FIGS. 3*a* and 3*b* are simplified representations of the knitting machine concerned, as the forked selector jacks 18' are, in a conventional manner, subdivided into groups, successive selector jacks of a group having their butts 20' positioned at different levels. Accordingly, each cam system has a number of selectors 32' located at different levels, which corresponds to the number of the forked selector jacks of the group concerned.

According to the invention, each cam system has, at the level of the second butt 16*d'*, a circular control track 40' for the second butt 16*d'* of the lower part 16*b'* of the knitting needles. A rotatable delay-action cam 42' is positioned in this circular control tack 40', and defines a needle lowering edge surface 44' for the butts 16*d'*. By means of this delay-action cam 42' those needles which are not knitting at the particular feed system concerned of the knitting frame can undergo a subsequent downward thrusting action, this being possible as the butts 16*d'* engage in the circular control track. The extent to which these particular needles are thus subsequently downwardly pressed can be controlled by suitable adjustment of the after-pressing cam 42'.

The Jacquard circular knitting machine shown in FIGS. 3*a* and 3*b* operates as follows:

When the selector 32' — associated with a particular feed system of the circular knitting machine, or with a particular cam system and with a particular type of selector jack — is retracted, the needle lowering butt 16*c'* remains in the first cam track 12', after these butts 16*c'* have been pivoted toward the cam cylinder 10' in advance of the selection station, constituted by the selector 32'; this pivotal motion of the butts 16*c'* is caused by the forked selector jacks 18', which have been pivoted on to the cam cylinder 10' by an oblique surface of the return cam 24', which lies in front of each selection station. This pivoted position of the forked selector jack 18' is shown in continuous line in FIG. 3*b*. The associated needles then knit normally in this feed system of the knitting machine, and the second butts 16*d'* of the lower part 16*b'* of the needles will then not engage in the circular control track 40' and, accordingly, will not engage the after-pressing cam 42'.

When, on the other hand, the selector 32' is urged out of its position, illustrated in continuous lines, FIG. 3*b*, in the direction of the needle cylinder, the forked selector jacks 18' are once again swivelled away from the cam cylinder 10' at the selection station, this being effected by an oblique surface at the front end of the selector 32'. The position thus assumed by the selector jacks 18' is shown in chain-dotted line in FIG. 3*b*. The lower part 16*b'* of the needles is then entrained by the forked selector jacks 18' away from the cam cylinder 10' causing the needle control butt 16*c'* to disengage from, the first cam track 12', while the second needle butts 16*d'* are pivoted so as to cause them to engage in the circular control track 40'. The needle butts 16*d'* remain in their positions, as shown in chain-dotted line in FIG. 3*b* until the forked selector jacks 18' are pivoted back to the cam cylinder 10', in the next feed system of the knitting frame, by the return cams 24' associated with these selector jacks 18'. In this way the needle lowering butts 16*c'* of the non-knitting needles pass by the needle lowering (stitch) cam 14', without coming into contact with the latter. However, it is possible, through the provision of a suitably adjusted delay-action cam 42', to subject the non-knitting needles to a subsequent downward pressing action, for example for the purpose of casting off any loops which may be still suspended from the needle heads. Such a delay-action cam 42' is particularly advantageous in Jacquard circular-knitting machines for knitting interlock knitted fabrics as described on pages 388–392 in WIRKEREI-UND STRICKEREI-TECHNIK of June 1973, whereby the casting off of the short loops from the non-knitting needles is ensured by this arrangement.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An improvement in a multi-feed circular knitting machine, having a needle cylinder for reciprocally movably supporting a plurality of knitting needles and jacks as well as a cam cylinder surrounding the needle cylinder and adapted to coact with said jacks, said needle cylinder and said cam cylinder being rotatable relative to each other, said jacks are suspended in the needles in an articulated manner, the improvement comprising a plurality of cam systems arranged on said cam cylinder for cooperation with said jacks and adapted to move said needles in knitting and non-knitting positions, each of said jacks is formed as a two-armed lever having a first arm with a first butt cooperating in a first position of the respective jack with a raising cam track in said cam systems for moving selected ones of the needles into their knitting positions, and with a second arm having a second butt cooperating in a second position of the respective jack with a further substantially linear cam track in said cam systems for guiding said needles into their non-knitting positions, a delay-action lowering cam in said further cam track for actuating said second butt to effect a cast-off of any loops held by the non-knitting needles, and pivoting means for pivoting preselected jacks from their first into their second positions and vice versa.

2. In a circular knitting machine as set forth in claim 1, wherein said lowering cam is provided on a rod rotatably mounted in said cam cylinder.

* * * * *